US010022757B2

(12) United States Patent
Ballu et al.

(10) Patent No.: US 10,022,757 B2
(45) Date of Patent: Jul. 17, 2018

(54) METHOD AND INSTALLATION FOR CLEANING A SPRAYING CIRCUIT, IN PARTICULAR OF PAINT, AND FOR TREATING THE CHEMICAL EFFLUENTS GENERATED

(75) Inventors: Patrick Ballu, Reims (FR); Philippe Briet, Oresmaux (FR); Philippe Poirier, Clamart (FR)

(73) Assignee: EXEL INDUSTRIES, Epernay (FR)

( * ) Notice: Subject to any disclaimer, the term of this patent is extended or adjusted under 35 U.S.C. 154(b) by 0 days.

(21) Appl. No.: 13/271,653

(22) Filed: Oct. 12, 2011

(65) Prior Publication Data

US 2012/0111369 A1 May 10, 2012

(30) Foreign Application Priority Data

Oct. 13, 2010 (FR) ..... 10 58331

(51) Int. Cl.
*B08B 9/032* (2006.01)
*B08B 9/027* (2006.01)
*B05B 15/55* (2018.01)

(52) U.S. Cl.
CPC ..... *B08B 9/0325* (2013.01); *B05B 15/55* (2018.02); *B08B 9/027* (2013.01)

(58) Field of Classification Search
None
See application file for complete search history.

(56) References Cited

U.S. PATENT DOCUMENTS

| | | | | |
|---|---|---|---|---|
| 4,968,447 | A * | 11/1990 | Dixon et al. | 510/202 |
| 5,192,595 | A * | 3/1993 | Akeel et al. | 427/421.1 |
| 5,699,817 | A | 12/1997 | Bankert et al. | |
| 5,701,922 | A | 12/1997 | Knipe, Jr. et al. | |
| 5,836,321 | A * | 11/1998 | Kaneski et al. | 134/10 |
| 5,882,428 | A | 3/1999 | Gawne | |
| 5,888,311 | A | 3/1999 | Laugenberg et al. | |
| 2005/0139237 | A1* | 6/2005 | Bahr | 134/22.1 |
| 2008/0134241 | A1* | 6/2008 | Kim et al. | 725/40 |
| 2009/0062610 | A1* | 3/2009 | Williams | A61B 1/123 600/118 |

FOREIGN PATENT DOCUMENTS

DE 195 24 211 A1 1/1997

OTHER PUBLICATIONS

French Search Report, dated Jul. 27, 2011, from corresponding French application.

* cited by examiner

*Primary Examiner* — Nicole Blan
(74) *Attorney, Agent, or Firm* — IPSILON USA, LLP

(57) ABSTRACT

A method for cleaning a spraying circuit, in particular of paint, and for treating the chemical effluents generated includes a first rinsing of the paint circuit using a predetermined first volume of treated effluent, a second rinsing of the paint circuit using a predetermined second volume of eco-solvent and a third rinsing of the paint circuit using a predetermined third volume of treated effluent, so as to save on the consumption of water from the network by recycling the treated effluent to clean and rinse the paint circuit.

8 Claims, 2 Drawing Sheets

Figure 1:
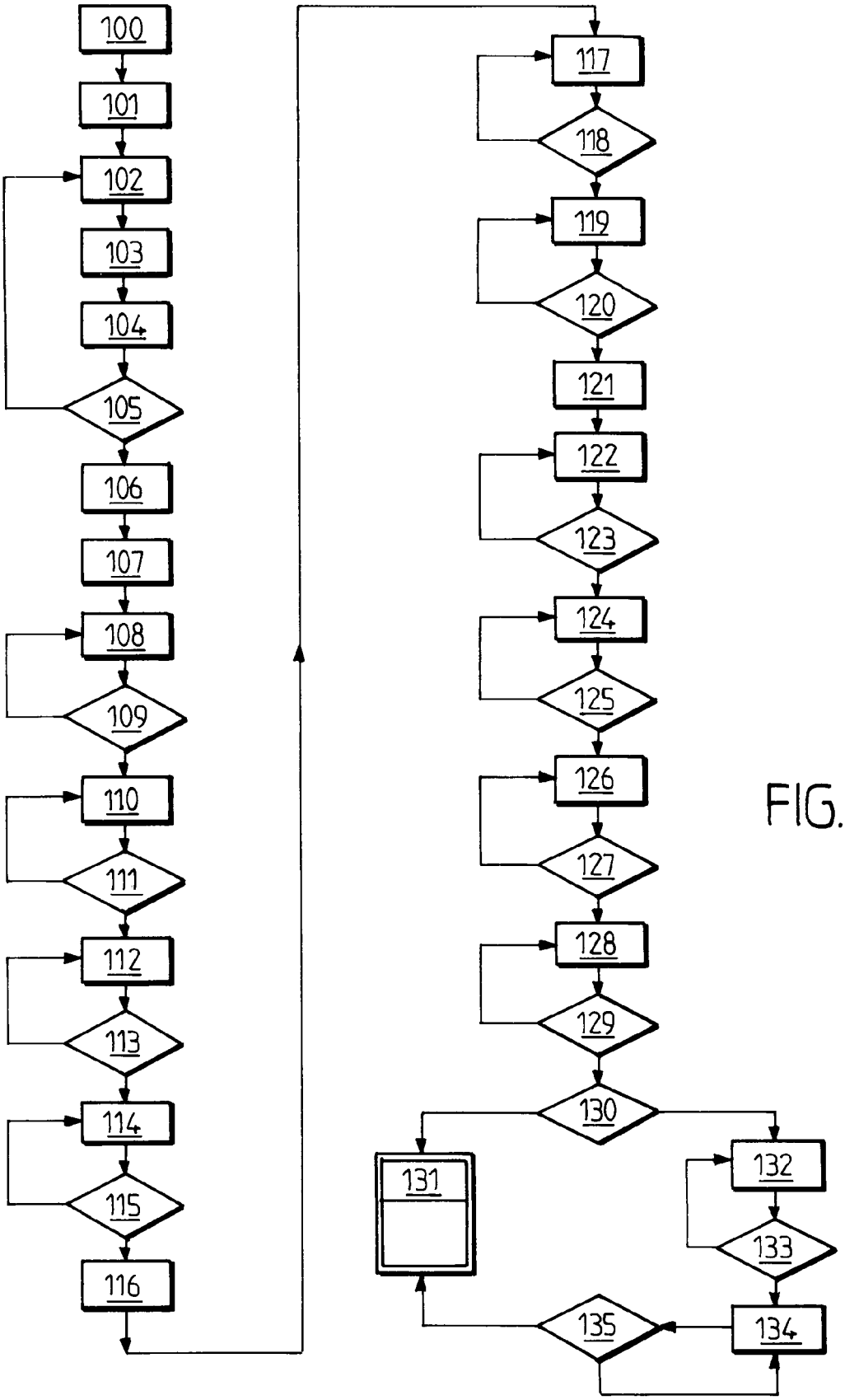

METHOD AND INSTALLATION FOR CLEANING A SPRAYING CIRCUIT, IN PARTICULAR OF PAINT, AND FOR TREATING THE CHEMICAL EFFLUENTS GENERATED

The invention relates to a method for cleaning a spraying circuit, in particular of paint, and for treating the chemical effluents generated.

The invention also relates to an installation for cleaning a spraying circuit, typically of paint, and for treating the chemical effluents generated.

The document U.S. Pat. No. 5,699,817 describes an apparatus for cleaning pipes by turbulent circulation.

The document U.S. Pat. No. 5,882,428 describes a circulation system rinsing method using cleaning plungers.

The French-registered company SPCB (Société des Produits Chimiques de Bretagne) manufactures and markets a system for treating water-soluble spraying circuit rinsing waters under the name ASPIFLOC.

In this ASPIFLOC system for treating water-soluble spraying circuit rinsing waters, the effluents to be treated are discharged to a storage tank for treatment comprising agitation by compressed air to homogenize the coagulation and the flocculation of the liquid elements and form a solid holding phase. After the coagulation and flocculation of the effluents, the content of the storage tank for treatment is transferred into a filtering bag holding the solid phase and restoring a decontaminated liquid phase. The treated effluents leaving the solid phase holding bag are discharged to a final treated effluents storage tank, almost entirely consisting of decontaminated aqueous liquid phase.

This ASPIFLOC system for treating water-soluble spraying circuit rinsing waters is generally satisfactory, but, however, requires a periodic consumption of water from the network to perform the rinsing of the water-soluble spraying circuit.

A first aim of the invention is to propose a novel method for treating chemical effluent, notably of paint, that makes it possible to save on the consumption of water from the network by recycling the treated effluent to clean and rinse the paint circuit.

A second aim of the invention is to guide the operator performing the cleaning and treatment of a paint circuit, semiautomatically, by guiding the operator to optimize the consumption of the ecosolvents or products used for the rinsing and to limit the risks of accident, incorrect operation and contamination of the environment, by the operator and the equipment.

The subject of the invention is a method for cleaning a spraying circuit, in particular of paint, and for treating the chemical effluents generated, comprising the following steps:

a) preparation and purging of the paint pump suction line;
b) first rinsing of the paint circuit using a predetermined first volume of treated effluent;
c) second rinsing of the paint circuit using a predetermined second volume of ecosolvant;
d) third rinsing of the paint circuit using a predetermined third volume of treated effluent;

so as to save on the consumption of water from the network by recycling the treated effluent to clean and rinse the paint circuit.

According to other alternative characteristics of the invention:

The step for preparation and purging of the paint pump suction line comprises a connection of a spraying gun or means to a rinsing module, a disconnection of a suction means or suction can, and an ejection of the waste by the paint pump to a waste container.

Several suction means or cans associated with isolating means or valves can be used to implement a method according to the invention.

The step of first rinsing of the paint circuit using a first predetermined volume of treated effluent advantageously comprises a filling of a cleaning tank with a first predetermined volume of treated effluent, a prerinsing of the paint circuit through the spraying gun or means to a container of ecosolvent, and a rinsing of the paint circuit through the spraying gun or means to an effluent treatment station.

The step of second rinsing of the paint circuit using a second predetermined volume of ecosolvent advantageously comprises a filling of a cleaning tank with a second predetermined volume of ecosolvent, a rinsing of the paint circuit through the spraying gun or means to a container of ecosolvent.

The step of third rinsing of the paint circuit using a third predetermined volume of treated effluent advantageously comprises a filling of a cleaning tank with a third predetermined volume of treated effluent, a prerinsing of the paint circuit through the spraying gun or means to a container of ecosolvent, and a rinsing of the paint circuit through the spraying gun or means to an effluent treatment station.

The method according to the invention may advantageously comprise an additional step of adjusting the tint of the paint circuit by ejection to a waste container until the desired tint is obtained.

Also the subject of the invention is an installation for cleaning a spraying circuit, in particular of paint, and for treating the chemical effluents generated, comprising:

a) means for preparing and purging the paint pump suction line;
b) means for first rinsing of the paint circuit using a predetermined first volume of treated effluent;
c) means for second rinsing of the paint circuit using a predetermined second volume of ecosolvant;
d) means for third rinsing of the paint circuit using a predetermined third volume of treated effluent;

so as to save on the consumption of water from the network by recycling the treated effluent to clean and rinse the paint circuit.

According to other alternative characteristics of the invention:

The means for preparing and purging the paint pump suction line comprise a rinsing module equipped with means for connecting a spraying gun or means, a waste container and a valve for isolating and ejecting waste via the paint pump to the waste container.

Several suction means or cans associated with isolation means or valves can advantageously be used for a selective communication to the paint pump.

The installation according to the invention advantageously comprises at least one cleaning tank suitable for filling with predetermined volumes of treated effluents or of ecosolvents, for rinsing the paint circuit through the spraying gun or means to an appropriate destination.

The installation advantageously comprises a treatment station consisting of a storage tank for treatment with stirring, a solid phase filtration bag and a treated effluent container.

The treatment installation is advantageously driven by a programmable logic or logic controller providing step-by-step guidance for the operator, to avoid the risks of incorrect operation and accidents to equipment and personnel that might result therefrom.

The invention will be better understood from the following description, given as a nonlimiting example with reference to the appended drawings in which:

FIG. 1 schematically represents a flow diagram of a method for cleaning and treating chemical effluents, in particular of paint, according to the invention.

Figure 2:
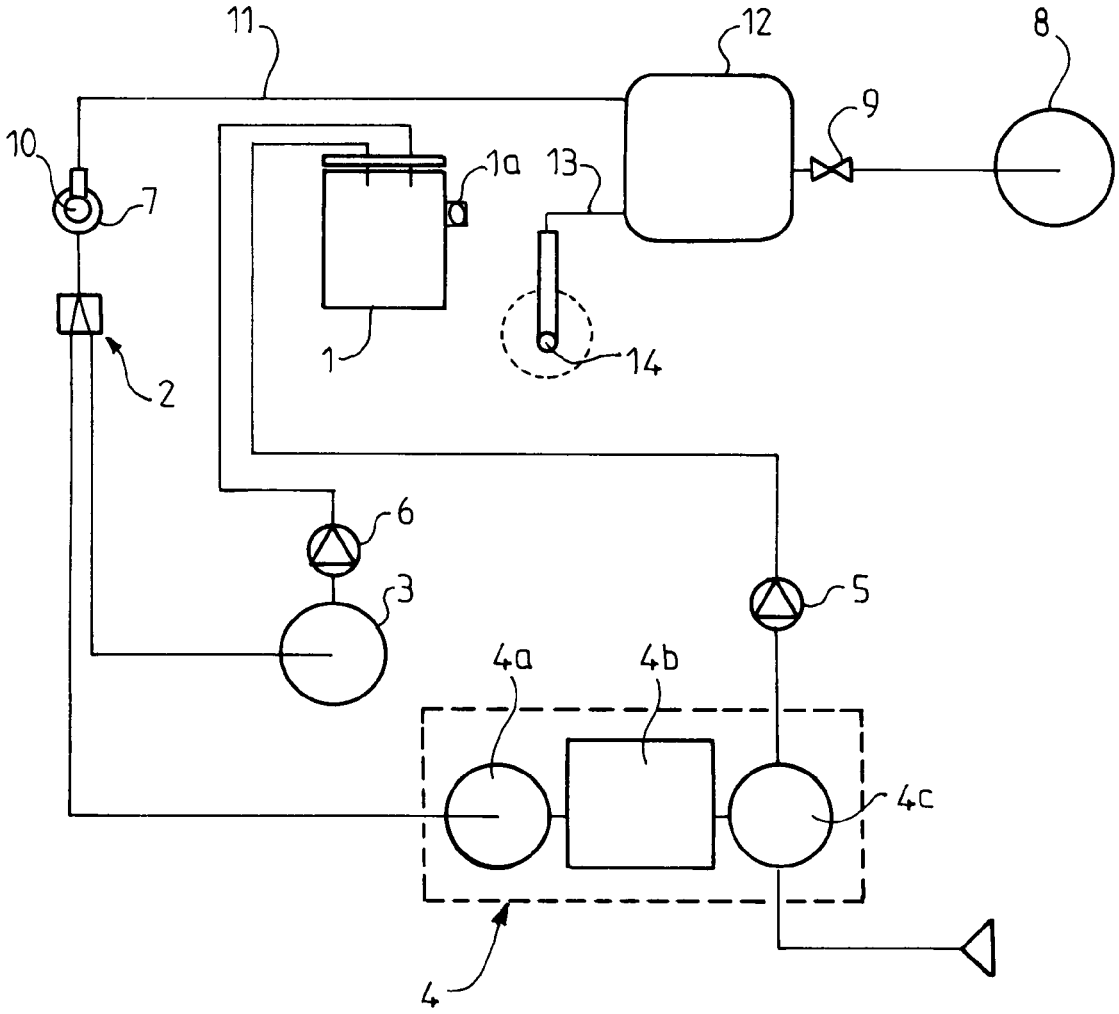

FIG. 2 schematically represents a circuit of an installation for cleaning and treating chemical effluents, notably of paint, according to the invention.

With reference to FIG. 1, a method for cleaning and treating chemical effluents, in particular of paint, is preferably executed with the assistance of a programmable logic controller giving authorizations to go on to the next step when the tested operating conditions are observed.

In the step 100, the end of a painting procedure is recorded by operator selection and confirmation of this selection is recorded on a terminal suitable for controlling a programmable logic controller.

In the step 101, the procedure is stopped and the decompression of the paint pump is ordered to depressurize the paint circuit.

In the step 102, the spraying gun or means is connected in a leak-tight manner to a rinsing module, the feed can is disconnected from the paint tank to which it is fixed and this can is connected to an appropriate connection of a cleaning tank.

In the step 103, the paint circuit is pressurized, preferably using the paint pump, to perform a purging of the pipes to a waste container suitable for isolation by an isolation valve.

In the step 104, the waste container is isolated and a rinse request is given to the programmable logic controller.

In the step 105, a test is performed to check the leak-tight connection of the circuit in a rinsing configuration and to avoid the risks of contamination from outside the rinsing circuit.

If the test of the step 105 is negative, the method loops to the step 102 to check all the rinsing circuit.

In the step 106, a treated effluent tank level test is performed, by, only if necessary, topping up with water from the network to obtain the desired level.

In the step 107, a cleaning tank is filled, by pumping from the treated effluent tank described in the step 106, until a predetermined level is obtained that is representative of a predetermined first volume V1 of treated effluent.

In the step 108, a prerinse request is initiated on the programmable logic controller, after having selected the position of a two-way valve to direct the rinsed products to a container of ecosolvent.

In the step 109, the conditions of integrity of the prerinsing circuit comprising the cleaning tank, the feed can, the paint pump, the spraying pipes as far as the spraying gun or means, the rinsing module and the pipes passing through the two-way valve to the container of ecosolvent, is carried out.

In the step 110, a prerinsing is performed in the direction of the container of ecosolvent for a short duration corresponding to the circulation of one or two times the volume of the paint circuit.

In the stage 111, an end-of-prerinsing test is performed by means of an appropriate sensor, or after a predetermined duration measured by a counter or a clock of the programmable logic controller.

In the step 112, a request for first rinsing with treated effluent is signaled to the operator, at the same time as the abovementioned two-way valve is switched to an effluent treatment station.

In the step 113, a test is performed to check the integrity of the rinsing circuit from the cleaning tank to the effluent treatment station. If the test is negative, the method loops to the step 112.

In the step 114, a first rinsing using the volume V1 of treated effluent loaded in the cleaning tank in step 107 is performed in the direction of the treatment station, passing through the feed can, the paint pump, the spraying circuit, the spraying gun or means, the rinsing module, the two-way valve and the corresponding pipe.

In the step 115, a test for the end of rinsing with treated effluent is performed. If the test is negative, the method loops to the step 114.

In the step 116, a request for second rinsing by ecosolvent is signaled, at the same time as a test of the level of the cleaning tank is performed to check the use of the volume V1 of treated effluent.

In the step 117, the cleaning tank is filled with a volume V2 of ecosolvent, and the two-way valve is switched towards the container of ecosolvent to establish a circuit for rinsing with ecosolvent.

In the step 118, a test of the conditions of integrity of the circuit for rinsing with ecosolvent is performed. If the test is negative, the method loops to the step 117.

In the step 119, a second rinsing with ecosolvent is performed using the volume V2 of ecosolvent loaded in the step 117.

The volume V2 of ecosolvent taken from the container of ecosolvent in the step 117 thus again refills the container of ecosolvent from which it was taken, after rinsing of the paint circuit through the spraying gun or means connected in a leak-tight manner to the rinsing module.

In the step 121, a third rinse request is made by using a treated effluent. A test of the level of the cleaning tank is performed to check the correct flow of the volume V2 of ecosolvent used in the preceding steps of second rinsing with ecosolvent.

In the step 122, the cleaning tank is filled with a predetermined third volume V3 of treated effluent and the two-way valve is oriented toward the container of ecosolvent.

In the step 123, a test of the conditions of the circuit for prerinsing with treated effluent is performed. If the test is negative, the method loops to the step 122.

In the step 124, a prerinsing of the paint circuit with treated effluent is performed for a short duration corresponding to the flow of one or two times the volume of the paint circuit, in the direction of the container of ecosolvent.

In the step 125, an end-of-prerinsing test is performed by appropriate sensors, or after a fixed predetermined duration using a counter or an internal time base of the programmable logic controller.

In the step 126, a request for third rinsing with treated effluent is signaled and a selection of the two-way valve is made to orient it to an effluent treatment station.

In the step 127, a test of the conditions of integrity of the circuit for third rinsing with treated effluent is performed to check the circuit starting from the cleaning tank, the suction can, the paint pump, the spraying circuit comprising the spraying gun or means through the rinsing module passing through the two-way valve to a storage container for effluents to be treated of the treatment station. If the test is negative, the method loops to the step 126.

In the step 128, a third rinsing of the paint circuit is performed by using the predetermined third volume V3 of treated effluent to make it circulate to the treatment station.

In the step 129, a test at the end of the third rinsing step based on treated effluent is performed to check the consumption of the predetermined volume V3 of treated effluent placed in the tank in the step 112. If the test is negative, the method loops to the step 108.

After the end of the third rinsing, an operational test of the cleaned paint circuit is performed in the step 130 by the programmable logic controller to determine the sequence of the operations. If no command is given by the operator by push button acknowledgement, the method goes on to the end-of-method step 131.

If a command to restart painting is given by the operator after the step 130, the method goes on to the step 132 requesting tint adjustment. At the time of the tint adjustment request, the operator must connect the feed can to a tank of paint of the desired tint, and must connect the spraying circuit as far as the gun to a waste container.

In the step 133, a test of the connection conditions is performed to check that the feed can is correctly in place on its paint tank and that the spraying gun is correctly in place on the waste container. If the test is negative, the method loops to the step 132.

If the test is positive, the method goes on to the tint adjustment step 134 for a spraying duration that is sufficient to fill the paint spraying circuit with the desired tint.

After the tint adjustment operation of the step 134, there is a test of the end of tint adjustment in the step 135. If the test is negative, the method loops to the step 134. If the test is positive, the method is terminated in the end-of-method step 131.

The painting installation is then ready to be used for new water-soluble paint spraying operations.

The invention described with reference to a particular installation for cleaning and treating paint effluents also extends to the cases of multiple feed cans, isolated or not by selective connections or by isolation valves allowing for a selective feed to the paint pump, a rinsing or any other operation implementing the invention.

With reference to FIG. 2, an installation for cleaning a spraying circuit, in particular of paint, and for treating the chemical effluents generated according to the invention comprises a cleaning tank (1) provided with appropriate sensors which are not represented, for measuring the levels corresponding to predetermined volumes V1 and V3 of treated effluent or V2 of ecosolvent.

The installation also comprises a three-way valve (2) allowing for a selective orientation of a rinsing circuit to a container (3) of ecosolvent or a container (4*a*) of effluent to be treated.

The container (4*a*) of effluent to be treated forms part of a treatment station (4) also comprising a filtration bag (4*b*) and a tank (4*c*) of treated effluent.

The tank (4*c*) of treated effluent of the treatment station (4) is linked to a pump (5) for feeding the cleaning tank (1).

The container (3) of ecosolvent is associated with a pump (6) for feeding the cleaning tank (1).

A rinsing module (7) is provided for the leak-tight connection of a spraying gun (10) linked via a spraying pipe (11) to a pump (12) fed by a pipe (13) linked to a feed can (14).

A non-recyclable waste container (8) can be fed, by a pipe that can be isolated via an isolation valve (9), to collect the waste at the start of cleaning.

The cleaning tank (1) preferably includes a glove finger (1*a*) allowing for the leak-tight connection of the feed can (14) of the paint circuit.

The effluent treatment station (4) is advantageously a treatment station manufactured and marketed under the name ASPIFLOC by the Société de Produits Chimiques de Bretagne (SPCB) and does not require a more detailed description.

A programmable logic controller which is not represented advantageously includes program code instructions representative of the steps of the method represented and described with reference to FIG. 1.

The method can be totally automated, can be semi-automatic, or can consist of a sequence of manual operations authorized after the acknowledgement of defects corresponding in particular to negative tests.

The invention described with reference to a particular embodiment is in no way limited thereto, but, on the contrary, covers any modification of form or any variant embodiment within the context and the spirit of the invention.

Thus, the treatment station (4) can be combined with one or more painting installations each associated with its own cleaning tank, entailing the use of appropriate switching, distribution and selection valves, according to a practice known to those skilled in the art.

In particular, the invention also extends to the case of painting circuits for bodyworks of large size, for example heavy goods vehicles or railway rolling stock, comprising one painting installation to the right of the rolling stock and one painting installation to the left of the rolling stock.

The invention claimed is:

1. A method for cleaning a paint circuit, and for treating chemical effluents generated, comprising:

a) preparing and purging a suction line of a paint pump;

b) filling of a cleaning tank with a first predetermined volume of water based treated effluent obtained from an independent treated effluent container, and conducting a first rinsing of the paint circuit using said predetermined first volume of treated effluent, said first predetermined volume of treated effluent being dispensed and returned to said independent treated effluent container that separates collected solids collected from said paint circuit from a liquid portion of said treated effluent, the liquid being for future rinsing of said paint circuit;

c) after completion of the first rinsing, filling of a tank with a second predetermined volume of ecosolvent separate from said first predetermined volume of water based treated effluent and obtained from a separate ecosolvent container that is independent of both said cleaning tank and said independent treated effluent container, and conducting a second rinsing of the paint circuit using said predetermined second volume of ecosolvent;

d) after completion of the second rinsing, filling of a cleaning tank with a third predetermined volume of water based treated effluent separate from said second predetermined volume of ecosolvent from said independent treated effluent container and conducting a third rinsing of the paint circuit using said predetermined third volume of water based treated effluent, said predetermined third volume of water based treated effluent being dispensed from and returned to said independent treated effluent container that separates collected solids collected from said paint circuit from a liquid portion of said treated effluent, the liquid portion being for future rinsing of said paint circuit;

wherein said method saves on water consumption in the paint circuit by recycling the first and third predetermined volumes of water based treated effluent to clean and rinse the paint circuit, wherein the first and third predetermined volumes of water based treated effluent and the ecosolvent are different and separate solutions, stored in separate containers, and independently employed at different stages of said method.

2. The method as claimed in claim 1, wherein the step of preparing and purging the paint pump suction line comprises connecting a spraying gun or means to a rinsing module, disconnecting a suction means or suction can, and ejecting waste by the paint pump to a waste container.

3. The method as claimed in claim 2, wherein the first rinsing of the paint circuit using the first predetermined volume of water based treated effluent advantageously comprises, prerinsing the paint circuit through the spraying gun or means to the separate ecosolvent container, and rinsing the paint circuit through the spraying gun or means to an effluent treatment station.

4. The method as claimed in claim 2, wherein the second rinsing of the paint circuit using the second predetermined volume of ecosolvent advantageously rinsing the paint circuit through the spraying gun or means to the separate ecosolvent container.

5. The method as claimed in claim 2, wherein the third rinsing of the paint circuit using the third predetermined volume of water based treated effluent advantageously comprises, prerinsing the paint circuit through the spraying gun or means the separate ecosolvent container, and rinsing the paint circuit through the spraying gun or means to an effluent treatment station.

6. The method as claimed in claim 1, wherein several suction means or cans associated with isolating means or valves are used for selective communication with the paint pump.

7. The method as claimed in claim 1, further comprising adjusting a tint of the paint circuit by ejection to a waste container until the desired tint is obtained.

8. The method as claimed in claim 2, wherein several suction means or cans associated with isolating means or valves are used for a selective communication to the paint pump.

* * * * *